US007088930B2

(12) United States Patent
Mimura

(10) Patent No.: US 7,088,930 B2
(45) Date of Patent: Aug. 8, 2006

(54) IMAGE FORMING APPARATUS AND TONER REPLENISHING METHOD

(75) Inventor: Toshifumi Mimura, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/006,680

(22) Filed: Dec. 8, 2004

(65) Prior Publication Data

US 2005/0129420 A1 Jun. 16, 2005

(30) Foreign Application Priority Data

Dec. 10, 2003 (JP) ..... 2003-411810

(51) Int. Cl.
*G03G 15/06* (2006.01)
*G03G 15/08* (2006.01)

(52) U.S. Cl. ..... 399/27; 399/258; 399/261

(58) Field of Classification Search ..... 399/262, 399/258, 27, 53, 260, 120, 261; 430/120
See application file for complete search history.

(56) References Cited

U.S. PATENT DOCUMENTS 4,937,627 A * 6/1990 Ozawa et al. ..... 399/224
5,848,326 A * 12/1998 Komuro et al. ..... 399/98
6,256,459 B1 * 7/2001 Hasegawa et al. ..... 399/27
6,289,182 B1 * 9/2001 Umezawa et al. ..... 399/12
6,314,261 B1 * 11/2001 Omata et al. ..... 399/258
2002/0001485 A1 * 1/2002 Ichikawa et al. ..... 399/262
2006/0029404 A1 * 2/2006 Hirota et al. ..... 399/27

FOREIGN PATENT DOCUMENTS

JP 09-034234 A * 2/1997
JP 10-319706 A 12/1998
JP 2000-231254 A 8/2000
JP 2001-125358 A 5/2001
JP 2001-125358 * 11/2001
JP 2002-139905 A 5/2002
JP 2002-341636 A 11/2002
JP 2003-323035 A 11/2003

* cited by examiner

*Primary Examiner*—Sophia S. Chen
(74) *Attorney, Agent, or Firm*—Foley & Lardner LLP

(57) ABSTRACT

A printer control CPU of the image forming apparatus controls the normal toner replenishing rotation after rotating a toner bottle in the normal rotating direction by about ¾ turn and then immediately in the direction reverse to the normal rotating direction by about ¾ turn. These operations are performed twice as the process to separate residual toners adhered on the inner surface of a toner bottle.

12 Claims, 6 Drawing Sheets

| | AVERAGE RESIDUAL TONER (g) | δ (STANDARD DEVIATION) |
|---|---|---|
| CONVENTIONAL (n=25) | 8.24 | 3.39 |
| THIS EMBODIMENT (n=31) | 4.00 | 1.56 |
FIG. 7
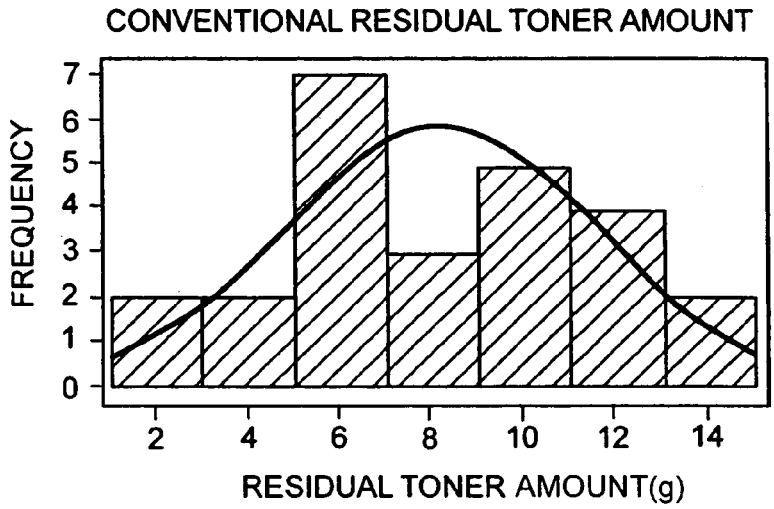
FIG. 8
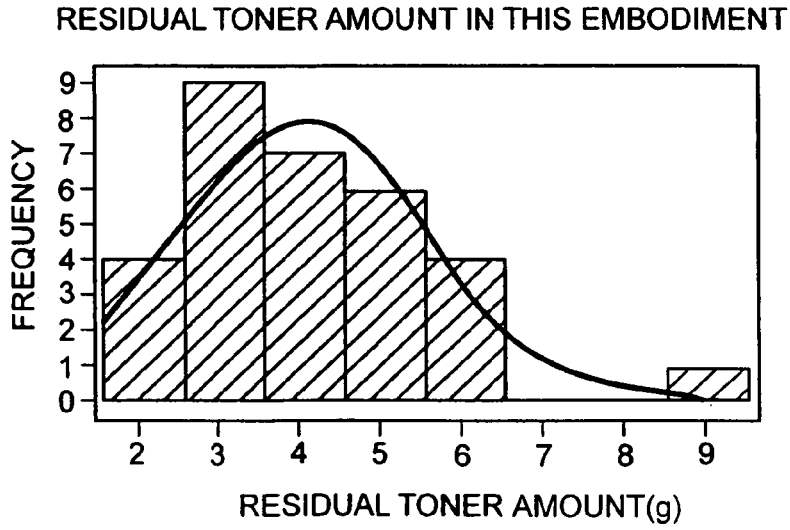
FIG. 9

IMAGE FORMING APPARATUS AND TONER REPLENISHING METHOD

CROSS-REFERENCE TO RELATED APPLICATION

This application is based upon and claims the benefit of priority from the prior Japanese Patent Application No. 2003-411810, filed on Dec. 10, 2003; the entire contents of which are incorporated herein by reference.

BACKGROUND OF THE INVENTION

1. Field of the Invention

The present invention relates to an image forming apparatus and a toner replenishing method to replenish toner to a developing device from a toner container.

2. Description of the Related Art

There are some electro-photographic image forming apparatus using a toner bottle or a toner cartridge as a toner container. In such an image forming apparatus, when a toner in a toner container decreases largely, a toner replenishing amount per one replenishing motion decreases continuously. The state where a preset toner density could not be reached even when a toner was replenished for a given length of time is regarded as a toner empty state. At this toner empty state, the image forming apparatus reports a user to exchange the toner container such as a toner bottle, a toner cartridge, etc.

Based on this report, the user removes an empty toner container from the main body of the image forming apparatus and exchanges it with a new toner container filled with toner. At this time, the empty container removed from the main body is often discarded in many cases.

In the toner empty state described above, over ten grams of toner adhered to the inner surface of the toner container is left as residual toner. In spite of this, there was such a problem that a toner container containing some residual toner was discarded.

For this problem, a method to use a spare toner by counter rotating a toner bottle is proposed, for example, a method disclosed in the Japanese Patent Application Publication No. 2002-139905.

This method, however, is merely to rotate a toner bottle in the reverse direction by several rotations in order to move spare toner. Further, there is also a conventional technology to give a mechanical vibration by providing a separate mechanism. For this technology, a mechanism must be provided to the main body of an image forming apparatus for this purpose and there were such problems as cost increase, securing of installing place, etc. Further, there are some users of image forming apparatus, who remove a toner container from an image forming apparatus and drop residual toners in containers by giving a shock to the toner container when a toner container was emptied. However, there were such troubles that during this period, the apparatus must be stopped and its efficiency drop, clothes or hands are made dirty when removing and hitting a toner container;

SUMMARY OF THE INVENTION

Accordingly, an advantage of the present invention is to provide an image forming apparatus and a toner replenishing method capable of largely reducing a residual toner amount in a toner container at the time of toner empty.

According to embodiments of the present invention, there is provided an image forming apparatus comprising: developing means for being replenished a toner from a toner container by rotating the toner container containing toner in a first direction; detecting means for detecting a toner amount in the toner container; and rotation control means for controlling a rotation of the toner container by less than one turn in a second direction reverse to the first direction when the detecting means detects that the toner amount in the toner container becomes less than a predetermined amount.

Further, according to embodiments of the present invention, ther is provided a toner replenishing method comprising: replenishing a toner to a developing device from a toner container by rotating the toner container in a first direction; detecting a toner amount in the toner container; and rotating the toner container in a second direction reverse to the first direction by less than one turn when the detecting step detects that the toner amount in the toner container becomes less than a predetermined amount.

BRIEF DESCRIPTION OF THE DRAWINGS

FIG. 7 is a table showing the results of a test to form an image on a large number of sheets;

FIG. 8 is a histogram showing frequency of residual amount of toner in a toner bottle in a conventional case; and FIG. 9 is a histogram showing frequency of residual amount of toner in a toner bottle in the embodiment of the present invention.

DETAIL DESCRIPTION OF THE INVENTION

Embodiments of the present invention will be explained below in detail referring to attached drawings.

Figure 1:
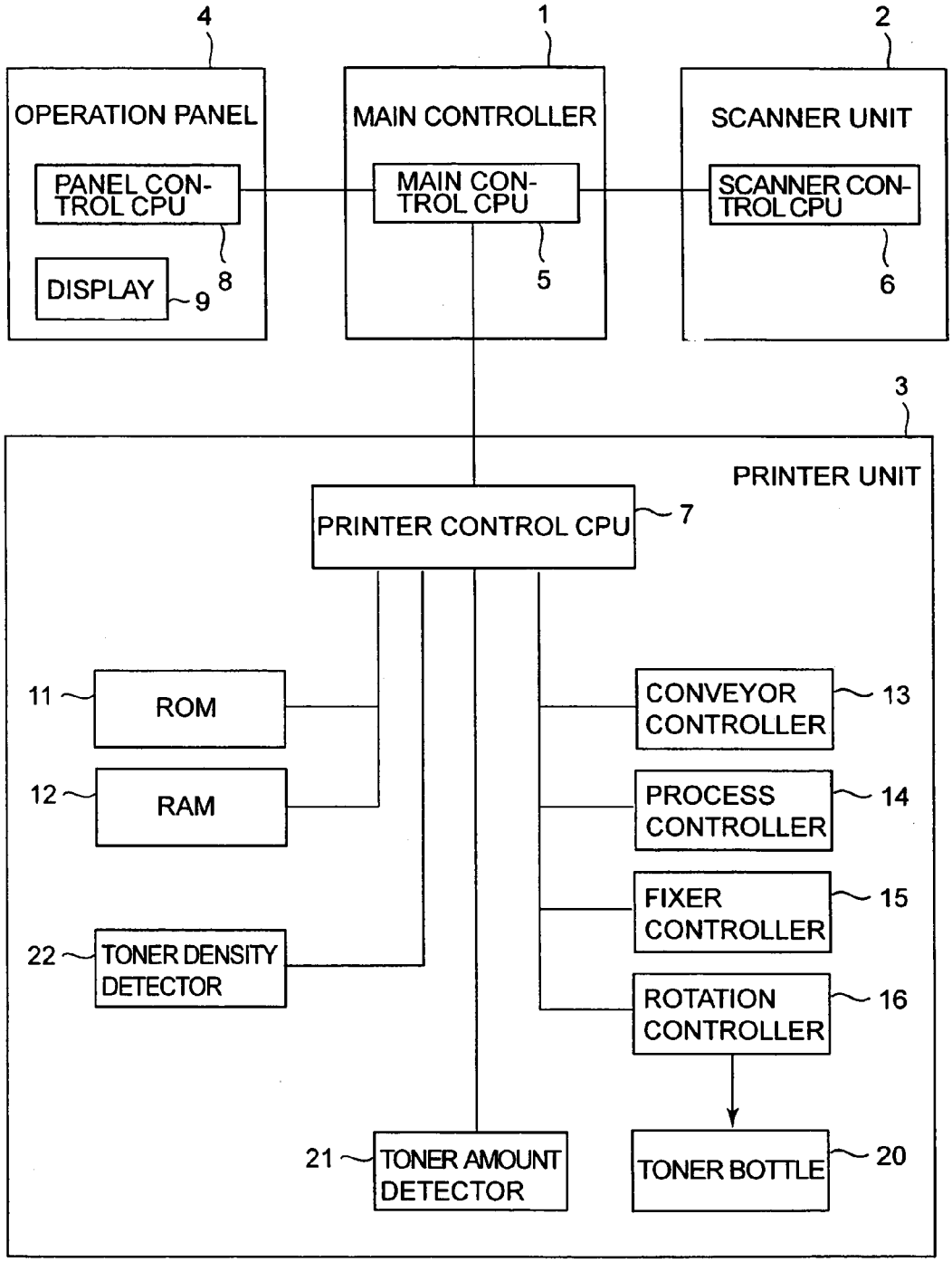
FIG. 1 is a block diagram showing the brief construction of an embodiment of an image forming apparatus in the present invention.

FIG. 1 shows the brief construction of an embodiment of an image forming apparatus in the present invention. The image forming apparatus comprises a main controller 1, a scanner unit 2, a printer unit 3 and an operation panel 4. A main control CPU 5 of the main controller 1 to control the entire apparatus is connected with a scanner control CPU 6 to control scanner unit 2, a printer control CPU 7 to control printer unit 3, and a panel control CPU 8 that controls operation panel 4. Further, a display 9 is connected to panel control CPU 8 of operation panel 4.

Printer control CPU 7 is connected with a ROM 11 which stores a control program and others, a RAM 12 for data storage, a conveyor controller 13 to control the convey of paper by a conveying mechanism (not shown), a process controller 14 to control the charging, developing and transferring processes, a fixer controller 15 to control a fixer (not shown), and a rotation controller 16 to rotate a toner bottle 20.

Further, printer control CPU 7 is connected with a toner amount detector 21 to detect a toner amount in toner bottle 20. Printer control CPU 7 is further connected with a toner density detector 22 to detect a toner density in a developing device, which is described later.

Figure 2:
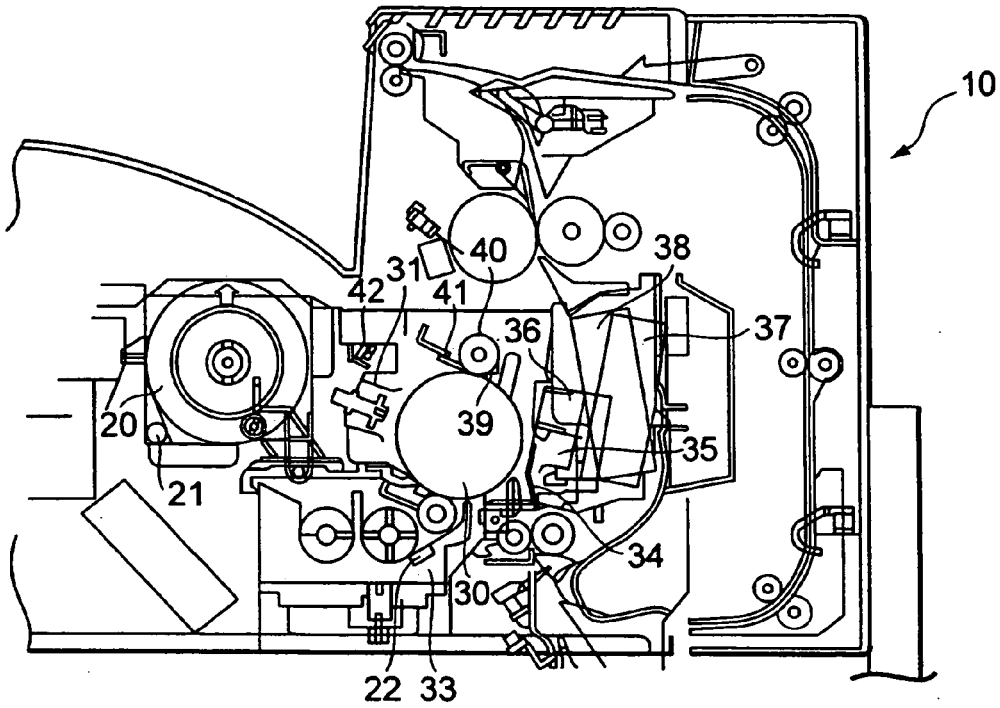
FIG. 2 is a cross-sectional view showing the brief construction around a toner bottle and a photosensitive drum.

FIG. 2 shows the brief construction around toner bottle 20 and a photosensitive drum 30. That is, around photosensitive drum 30 there are provided a main charger 31, a developing device 33, a transfer guide 34, a transfer charger 35, a separation charger 36, an exhaust fan 37, a separation assist fan 38, a recovery blade 39, a toner recovery auger 40, a cleaning blade 41 and a charge elimination lamp 42. Further, on a casing of developing device 33, toner density detector 22 is provided to detect a toner density in developing device 33. Toner amount detector 21 is arranged around toner bottle 20.

Figure 3A:
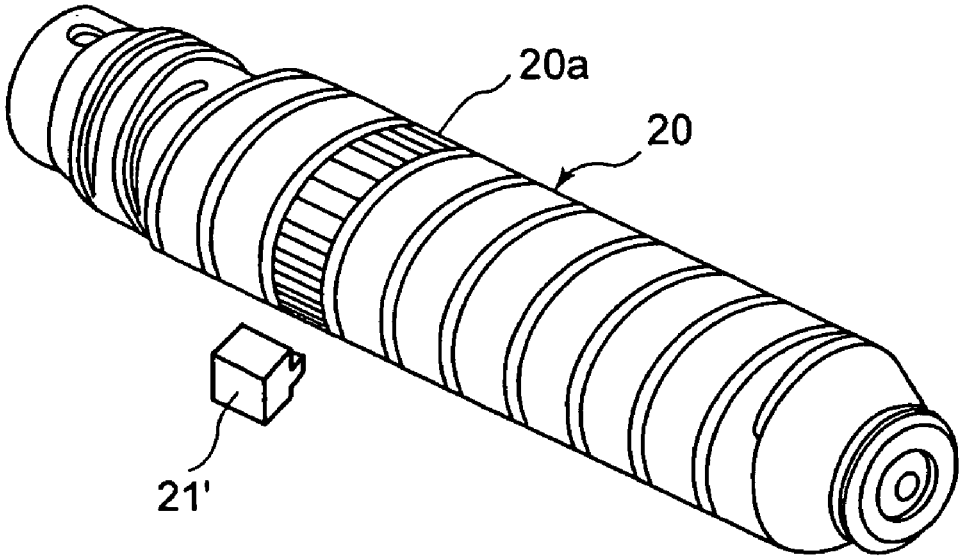
FIG. 3A is a perspective view showing the state to arrange an optical detector near the toner bottle as an example of a toner amount detector.
Figure 3B:
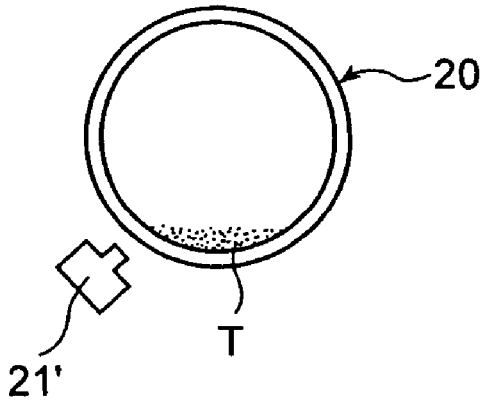
FIG. 3B is a cross sectional view showing the state to arrange an optical detector near the toner bottle as an example of a toner amount detector.

FIG. 3A shows an example of an optical detector 21' provided near the toner bottle 20 as toner amount detector 21. A part of the toner bottle 20 is formed as a transparent portion 20*a* in the circumferential direction. Optical detector 21' is arranged opposite to transparent portion 20*a*. As shown in FIG. 3B, optical detector 21' is provided at a height so that the level of toner T in toner bottle 20 can be detected when the toner amount decreases to the almost empty state.

As the toner density detector 22, for example, a magnetic detector is used. That is, when a two-component developer comprising toner and magnetic carrier is used as a developer, the decrease of a toner amount against the carrier; that is, the decrease of toner density is magnetically detected by the magnetic detector.

Figure 4:
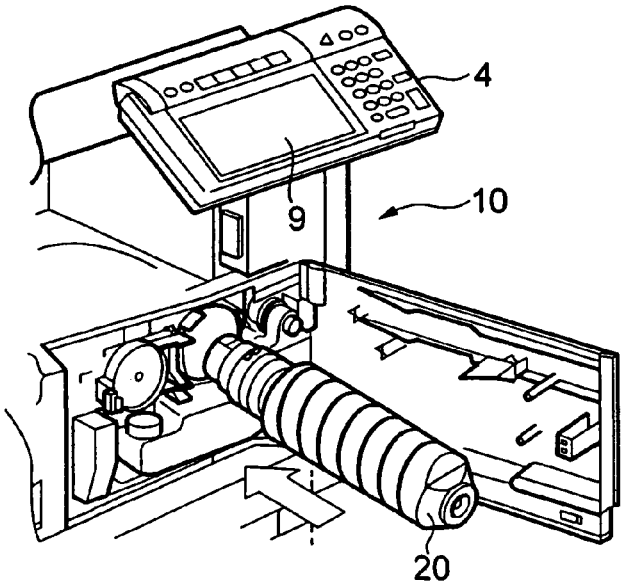
FIG. 4 is a perspective view showing the state to attach a toner bottle to the main body.

FIG. 4 is a perspective view showing toner bottle 20 and the state to install toner bottle 20 to a main body 10 of the image forming apparatus. As shown in FIG. 4, there is operation panel 4 provided on the top of main body 10. On operation panel 4, display 9 is provided.

Figure 5:
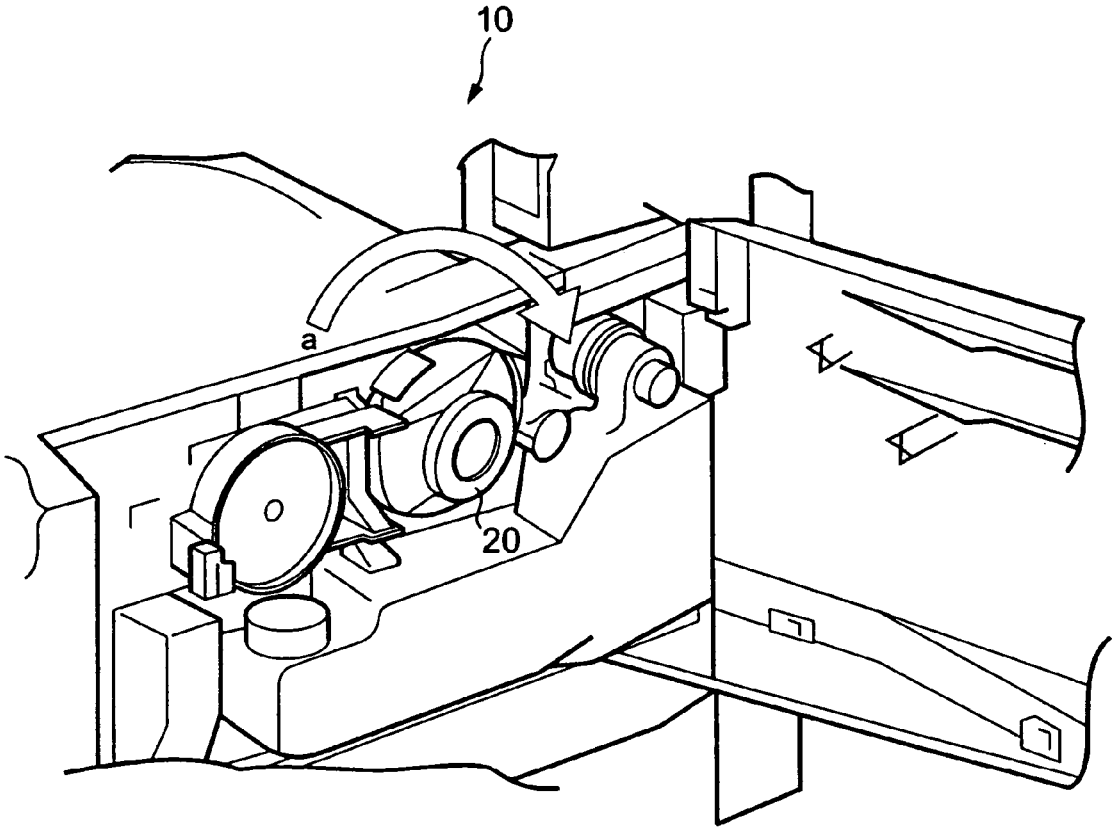
FIG. 5 is a perspective view showing the state of a toner bottle attached to the main body.

FIG. 5 shows the state of toner bottle 20 installed in main body 10. Further, the direction of the arrow mark "a" indicates the direction in which toner bottle 20 is rotated in the normal toner replenishing and will be described later in detail.

This embodiment when a two-component developing agent comprising a toner and a carrier is used will be explained below. However, the present invention is not restricted to the embodiment described below but can be applied to a single-component developing agent comprising toner only.

Figure 6:
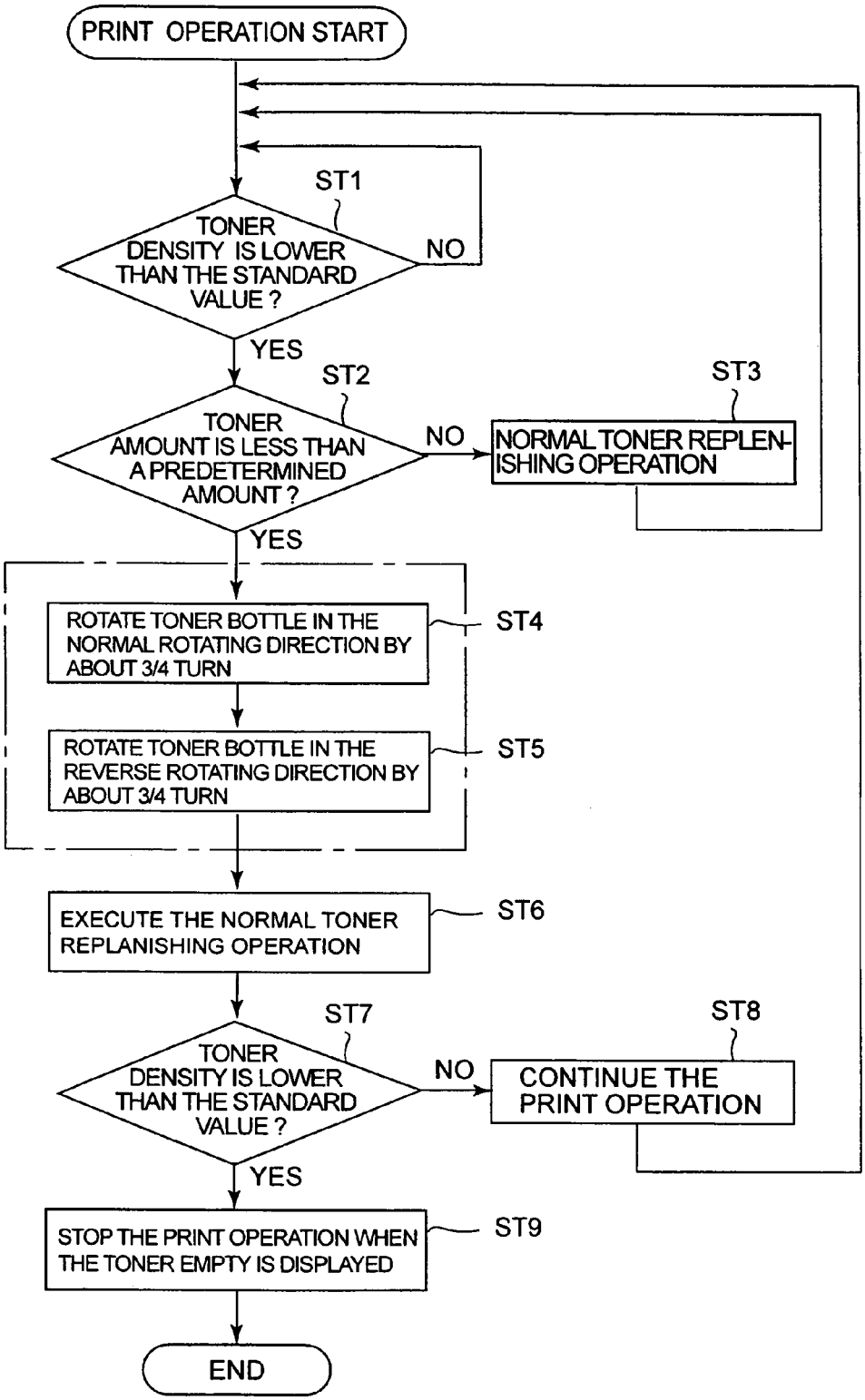
FIG. 6 is a flowchart for explaining a toner replenishing operation of an embodiment of the image forming apparatus in the present invention.

Next, the toner replenishing operation in the image forming apparatus of the embodiment in the structure as described above will be explained referring to a flowchart shown in FIG. 6.

First, when the printing operation is started by main control CPU 5, printer control CPU 7 judges whether the toner density is lower than a standard value by toner density detector 22 (ST1). When the toner density is judged to be lower than the standard value (ST1: YES), printer control CPU 7 judges whether a toner amount in toner bottle 20 is less than a predetermined amount (immediately before the empty of toner bottle 20) by toner amount detector 21 (ST2). Further, as a detecting method for a toner amount in toner bottle 20, plural standard values may be set for toner density detector 22 instead of using toner amount detector 21 to detect the toner amount in toner bottle 20.

When the toner amount is not less than the predetermined amount nearly (ST2: NO), printer control CPU 7 controls the normal toner replenishing operation from toner bottle 20 through rotation controller 16 (ST3). Toner bottle 20 is controlled by rotation controller 16 so that toner bottle 20 is rotated in about 1.3 seconds per one rotation; that is, the number of revolutions becomes about 48 r/min.

When the toner amount in toner bottle 20 is less than the predetermined amount (ST2: YES), printer control CPU7 rotates toner bottle 20 in the normal rotating direction (the clockwise direction when viewed from the front of main body 10) by about ¾ turn (ST4) and successively rotates toner bottle 20 in the reverse rotating direction (the counterclockwise direction when viewed from the front of main body 10) by about ¾ turn (ST5). Further, the operation in Steps ST4 and ST5 are repeated.

After repeating the operations in Steps ST4 and ST5 twice, printer control CPU7 controls the normal toner replenishing operation from toner bottle 20 through rotation controller 16 (ST6).

When the operation in Step ST6 is completed, printer control CPU7 judges whether the toner density in developing device 33 is lower than the standard value by toner density detector 22 (ST7).

When the toner density is above the standard value (ST7: NO), printer control CPU 7 continues the printing operation (ST8).

When the toner density is lower than the standard value (ST7: YES), printer control CPU 7 displays the toner empty on the display 9 on operation panel 4 and stops the printing operation (ST9).

In the above-mentioned embodiment, the operations in Steps ST4 and ST5 were repeated twice, but it may be one time or plural times. In short, it is sufficient if residual toner adhered to the inner surface of the toner bottle can be removed efficiently.

Further, when the toner density is lower than the standard value in Step ST7, the operations of Steps ST4 to ST7 may be repeated.

Then, using the image forming apparatus of the embodiment, the printing operation was carried out by supplying paper until the toner empty was displayed under two conditions in the conventional condition and that in this embodiment and toner amounts remained in toner bottle 20 after the toner empty was displayed were compared and examined. Further, a full toner amount in this toner bottle is 675 g.

As described above, in this embodiment, after rotating the toner bottle in the normal rotating direction by about ¾ turn, the bottle is rotated in the direction reverse to the normal rotating direction as the toner bottle rotation in the almost toner empty state. Making these rotations as one set, the step to remove residual toner adhered on the inner surface of the toner bottle was carried out twice. Thereafter, the normal toner replenishing operation was made.

As regard the normal/reverse rotating operation to remove residual toner adhered on the inner surface of the toner bottle, it is effective to repeat the normal/reverse rotation for a short time for removing residual toner from the inner surface as far as time is concerned rather than making the rotating operation in the normal direction for a long hour and then in the reverse direction for a long hour. It is therefore desirable to rotate the toner bottle by less than one turn for one rotation in the normal or the reverse rotation. This is because the short time normal/reverse rotation; that is, a rapid rotation gives a shock to the toner bottle and residual toner adhered on the inner surface of the toner bottle becomes easily removable. The rotation more than one turn will result in a long time and it is therefore desirable to turn the toner bottle by less than one turn.

FIG. 7 shows the results of the printing tests by supplying a large number of sheets. That is, at the number of samples 25, the average residual toner amount was so far 8.24 g and the standard deviation a was 3.39 g. In this embodiment, at the number of samples 31, the average residual toner amount was 4.00 g and the standard deviation was 1.56 g.

FIG. 8 is a histogram showing the frequencies of conventional residual toner amounts (n=25).

FIG. 9 is a histogram showing the frequencies of the residual toner amounts (n=31) in this embodiment.

As shown in FIG. 7 to FIG. 9, both of the average values of residual toner amount and standard deviation in this embodiment were less than half of conventional values. From these numerical values, when the effect of this embodiment to the residual toner amount was viewed from the statistical viewpoint, both are different and the effect of the present invention to the residual toner amount in the toner container in this embodiment was proved.

As explained above, according to the embodiment of the present invention, residual toner amount in the toner container in the toner empty state is largely decreased and it becomes possible to reduce wasteful discard of useful printable toner and environmental load associated with the discard toner disposition, and achieve the cost reduction.

Further, as a result of decrease in residual toner amount in the toner container in the toner empty state, the number of exchanges of a toner container (a toner bottle/a toner cartridge) is decreased and it becomes possible to improve the printing efficiency.

In the embodiment described above, when the toner bottle is in the almost empty state, the toner bottle is rotated in the normal rotating direction and then rotated in the reverse direction. However, the toner bottle may be first counter rotated and then, rotated in the normal rotating direction.

The image forming apparatus of the present invention is enabled to largely decrease a residual toner amount in the toner container in the toner empty state.

Further, the present invention is not restricted to the above-mentioned embodiment but can be modified variously without departing from the spirit and scope thereof in the execution phase. Further, the embodiments can be combined properly as could as possible and a combined effect is obtained. Further, inventions at various stages are contained in the embodiment and various inventions can be extracted by properly combining plural constituent requirements. For example, even when some of whole constituent requirements shown in the embodiment are deleted, the problems described in the paragraph of problems intended to solve by the invention can be solved and when the effects described in the paragraph of the effects of the invention are obtained, the construction with these constitutional requirements deleted is extracted as an invention.

What is claimed is:

1. An image forming apparatus comprising:

developing means for being replenished by a toner from a toner container by rotating the toner container containing toner in a first direction;

first detecting means provided on the developing means for detecting whether a toner density is lower than a standard value in the developing means;

second detecting means provided around the toner container for detecting whether a toner amount in the toner container is less than a predetermined amount when the first detecting means detects that the toner density in the developing means is lower than the standard value; and rotation control means for controlling a rotation of the toner container to rotate the toner container in a second direction reverse to the first direction by less than one turn and then, rotate in the first direction by less than one turn and repeat the rotations in both directions by one or plural times when the second detecting means detects that the toner amount in the toner container becomes less than the predetermined amount.

2. An image forming apparatus comprising:

developing means for being replenished by a toner from a toner container by rotating the toner container containing toner in a first direction;

first detecting means for detecting whether a toner density is lower than a standard value in the developing means;

second detecting means for detecting whether a toner amount in the toner container is less than a predetermined amount when the first detecting means detects that the toner density in the developing means is lower than the standard value; and rotation control means for making a first control to rotate the toner container in the first direction by less than one turn and successively in a second direction reverse to the first direction by less than one turn when the second detecting means detects that the toner amount in the toner container becomes less than the predetermined amount; and after repeating the rotation by the first control for one time or plural times, makes a second control to replenish the toner to the developing means from the toner container by rotating the toner container.

3. The image forming apparatus as claimed in claim 2, wherein the first detecting means is provided on the developing means.

4. The image forming apparatus as claimed in claim 2 wherein the second detecting means is provided around the toner container.

5. An image forming apparatus comprising:

a developing device to which toner is replenished from a toner container by rotating the toner container containing toner in a first direction;

a toner density detector provided on the developing device to detect whether a toner density is lower than a standard value in the developing device;

a toner amount detector provided around the toner container to detect whether a toner amount in the toner container is less than a predetermined amount when the toner density detector detects that the toner density in the developing device is lower than the standard value; and a rotation controller to control a rotation of the toner container to rotate the toner container in a second direction reverse to the first direction by less than one turn and then, rotate in the first direction by less than one turn and repeat the rotations in both directions by one or plural times when the toner amount detector detects that the toner amount in the toner container becomes less than the predetermined amount.

6. An image forming apparatus comprising:

a developing device to which toner is replenished from a toner container by rotating the toner container containing toner in a first direction;

a toner density detector to detect whether a toner density is lower than a standard value in the developing device;

a toner amount detector to detect whether a toner amount in the toner container is less than a predetermined amount when the toner density detector detects that the toner density in the developing device is lower than the standard value; and a rotation controller which makes a first control to rotate the toner container in the first direction by less than one turn and successively in a second direction reverse to the first direction by less than one turn when the toner amount detector detects that the toner amount in the toner container becomes less than the predetermined amount; and after repeating the rotation by the first control for one time or plural times, makes a second control to replenish the toner to the developing device from the toner container by rotating the toner container.

7. The image forming apparatus as claimed in claim 6, wherein the toner density detector is provided on the developing device.

8. The image forming apparatus as claimed in claim 6, wherein the toner amount detector is provided around the toner container.

9. A toner replenishing method in an image forming apparatus, comprising:

replenishing a toner to a developing device from a toner container by rotating the toner container in a first direction;

first detecting whether a toner density is lower than a standard value in the developing device;

second detecting whether a toner amount in the toner container is less than a predetermined amount when the first detecting detects that the toner density in the developing device is lower than the standard value; and rotating the toner container in a second direction reverse to the first direction by less than one turn when the second detecting detects that the toner amount in the toner container becomes less than the predetermined amounts, wherein the toner container is further rotated by less than one turn in the first direction after being rotated in the second direction by less than one turn, and the rotations in both directions by less than one turn are repeated one or plural times.

10. A toner replenishing method in an image forming apparatus, comprising:

replenishing a toner to a developing device from a toner container by rotating the toner container in a first direction;

first detecting whether a toner density is lower than a standard value in the developing device;

second detecting whether a toner amount in the toner container is less than a predetermined amount when the first detecting detects that the toner density in the developing device is lower than the standard value; and rotating the toner container in a second direction reverse to the first direction by less than one turn when the second detecting detects that the toner amount in the toner container becomes less than the predetermined amount, wherein the toner container is rotated in the first direction by less than one turn and successively in the second direction when the toner amount in the toner container becomes less than the predetermined amount; and after repeating the rotation in the first and the second directions by less than one turn by one or plural times, the toner is replenished to the developing device from the toner container by rotating the toner container.

11. An image forming apparatus comprising:

a developing device to which toner is replenished from a toner container by rotating the toner container containing toner in a first direction:

a toner density detector to detect whether a toner density is lower than a standard value in the developing device;

a toner amount detector to detect whether a toner amount in the toner container is less than a predetermined amount when the toner density detector detects that the toner density in the developing device is lower than the standard value; and a rotation controller to control a rotation of the toner container by less than one turn in a second direction reverse to the rotating direction when the toner amount detector detects that the toner amount in the toner container becomes less than the predetermined amount.

12. A toner replenishing method in an image forming apparatus, comprising:

replenishing a toner to a developing device from a toner container by rotating the toner container in a first direction;

first detecting whether a toner density is lower than a standard value in the developing device;

second detecting whether a toner amount in the toner container is less than a predetermined amount when the first detecting detects that the toner density in the developing device is lower than the standard value; and rotating the toner container in a second direction reverse to the first direction by less than one turn when the second detecting detects that the toner amount in the toner container becomes less than the predetermined amount.

* * * * *